United States Patent [19]

Liu

[11] Patent Number: 4,634,193

[45] Date of Patent: Jan. 6, 1987

[54] CABINET FOR STORING SMALL PARTS SUCH AS BOLTS SCREWS OR THE LIKE

[76] Inventor: Mike Liu, 2nd Fl., No. 442, Chang Chuen Road, Taipei, Taiwan

[21] Appl. No.: 758,775

[22] Filed: Jul. 25, 1985

Related U.S. Application Data

[63] Continuation-in-part of Ser. No. 684,854, Dec. 21, 1984, abandoned.

[51] Int. Cl.[4] ..... A47B 87/02

[52] U.S. Cl. ..... 312/107; 16/114 R; 16/115; 312/244; 312/348

[58] Field of Search ..... 312/348, 107, 111, 244, 312/350; 16/115, 114 R

[56] References Cited

U.S. PATENT DOCUMENTS

| | | | |
|---|---|---|---|
| 1,030,877 | 7/1912 | Doddridge et al. | 16/114 R |
| 2,118,323 | 5/1938 | Murphy | 312/244 |
| 2,506,844 | 5/1950 | Smith | 312/107 |
| 2,511,949 | 6/1950 | Simon | 312/107 |
| 2,769,679 | 11/1956 | Wiseman | 312/107 X |
| 2,987,151 | 6/1961 | Frambes | 16/115 |
| 3,032,381 | 5/1962 | Boro | 312/111 |
| 3,219,400 | 11/1965 | Bergquist | 312/244 X |
| 4,123,128 | 10/1978 | Abele | 312/244 |
| 4,155,611 | 5/1979 | Brekke et al. | 312/348 |
| 4,231,626 | 11/1980 | Amtmann et al. | 312/350 |

*Primary Examiner*—Kenneth J. Dorner
*Assistant Examiner*—Thomas A. Rendos
*Attorney, Agent, or Firm*—Bacon & Thomas

[57] ABSTRACT

An improved cabinet for storing bolts, screws or the like comprising a framework formed integrally by moulding, and a plurality of drawers which may slide in and out of the framework. The framework includes a number of vertical panels, a plurality of horizontal strips formed on each side of the vertical panels, and two retainers. The top of the framework is formed with raised edges having inclined surface which is configured for engagement by the bottom of another framework. Further, a handle is engaged with the retainers for enabling the cabinet to be carried more conveniently.

1 Claim, 8 Drawing Figures

CABINET FOR STORING SMALL PARTS SUCH AS BOLTS SCREWS OR THE LIKE

CROSS-REFERENCE TO RELATED APPLICATION

This application is a continuation-in-part of Applicant's co-pending application Ser. No. 684,854, filed Dec. 21, 1984, abandoned.

BACKGROUND OF THE INVENTION

The present invention relates to a cabinet for storing bolts, screws or the like.

Cabinets used for containing small parts such as screws, bolts and the like in the electric or electronic factory have been widely used. However, such conventional cabinets generally have many structural and constructive disadvantages when being constructed. One kind of such conventional cabinets generally comprises a front frame and a rear frame which are attached to the front and rear of a cabinet body respectively. Furthermore, a number of drawers being slideable in and out of the cabinet body are held in the cabinet body by means of supporting strips formed integrally with the cabinet body. The front and rear frames are provided with a number of stop strips respectively, which may prevent the drawers from detaching from the cabinet body.

This cabinet is generally made of plastics or the like and mainly comprises a front frame, a rear frame and a cabinet body which are formed by moulding. In other words, it is required to have three individual moulds and three moulding stages for manufacturing the cabinet. Furthermore, a further stage is required to attach the front frame and the rear frame to the front and rear of the cabinet body respectively. Accordingly, the production of a conventional cabinet is time-consuming and expensive.

SUMMARY OF THE INVENTION

In view of the disadvantages of the conventional cabinet for storing small parts such as bolts, screws and the like, the present invention aims at providing an improved cabinet which mainly comprises a framework formed integrally by moulding techniques, and a number of drawers which may slide in and out of the framework.

The framework according to the present invention is provided with a plurality of vertical panels, on which a number of strips and stops are formed integrally in order to hold the drawers and prevent the same from detaching from the framework. A number of panels are also formed integrally on the rear of the framework, which panels are also provided for preventing the drawers from sliding out of the framework. Furthermore, an attachment means is formed on the top surface of the framework for connecting with a handle means.

The prime feature of the present invention is that the framework may be formed by one moulding stage and the materials required for producing the framework may be reduced to the least extent whereby the cabinet according to the present invention can be made readily and inexpensively.

Another feature of the present invention is that it is possible to stack one cabinet on the other in a stable manner.

DETAILED DESCRIPTION OF THE PREFERRED EMBODIMENT

Figure 1:
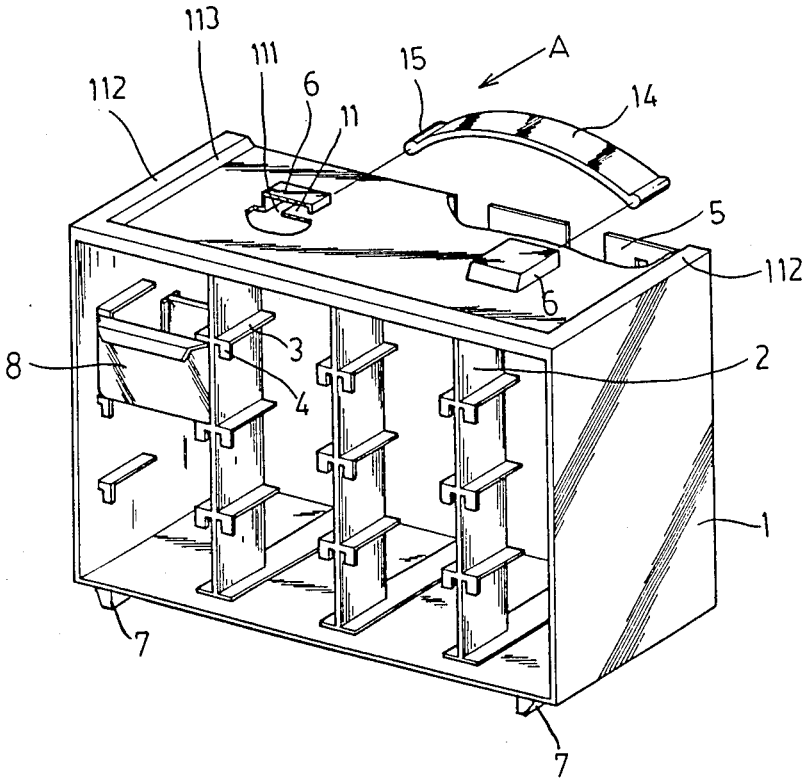
FIG. 1 is a perspective view of a cabinet according to a preferred embodiment of the present invention.
Figure 2:
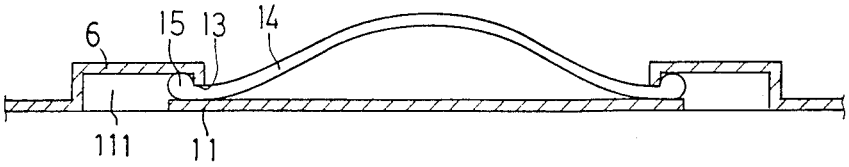
FIG. 2 is a fragementary sectional view of the cabinet, showing how the handle is connected with the top of the cabinet.
Figure 3:
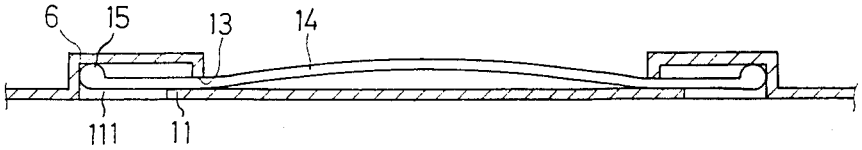
FIG. 3 is fragmentary sectional view similar to FIG. 2, with the handle pressed down.
Figure 4:
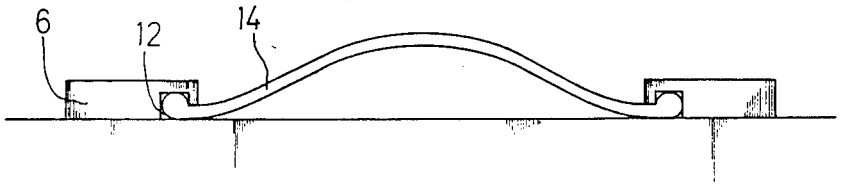
FIG. 4 is a fragmentary view taken from direction A of FIG. 1.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Referring to the drawings and in particular to FIGS. 1, 2, 3 and 4 thereof, the cabinet according to the present invention comprises a framework 1. The framework 1 is provided with a number of vertical panels 2. A plurality of horizontal supporting strips 3 are formed on each side of the vertical panels 2. A stop 4 is derived from the front end of each strip 3. A number of horizontal supporting strips 3 are also formed on the inner surface of both sides of the framework 1. With such arrangement, the drawers 8 may slide in and out of the framework 1, in which the strips 3 may hold drawers 8 and stops 4 may prevent the drawers 8 from detaching from the framework 1. The framework 1 is further provided with a number of stop panels 5 in the rear side thereof so as to keep the drawers 8 from dropping out of the framework 1.

The framework 1 is further provided with two retaining means 6 for connecting with a handle 14. The retaining means 6 is formed with an interior space 11, an opening 111 and a slit 13 (see FIGS. 2 and 3). Further, the rear of the retaining means 6 comes with an opening 12 the width of which is slightly larger than the diameter of the cylindrical portion 15 of the handle 14. To engage the handle 14 with the retaining means 6, simply insert the cylindrical portions 15 into corresponding openings 12 of the retaining means 6. Hence, the handle 14 can be moved up for carrying the cabinet or down when not in use. The surface of the retaining means 6, which faces to the front face of the framework 1, has an inclined surface.

Figure 7:
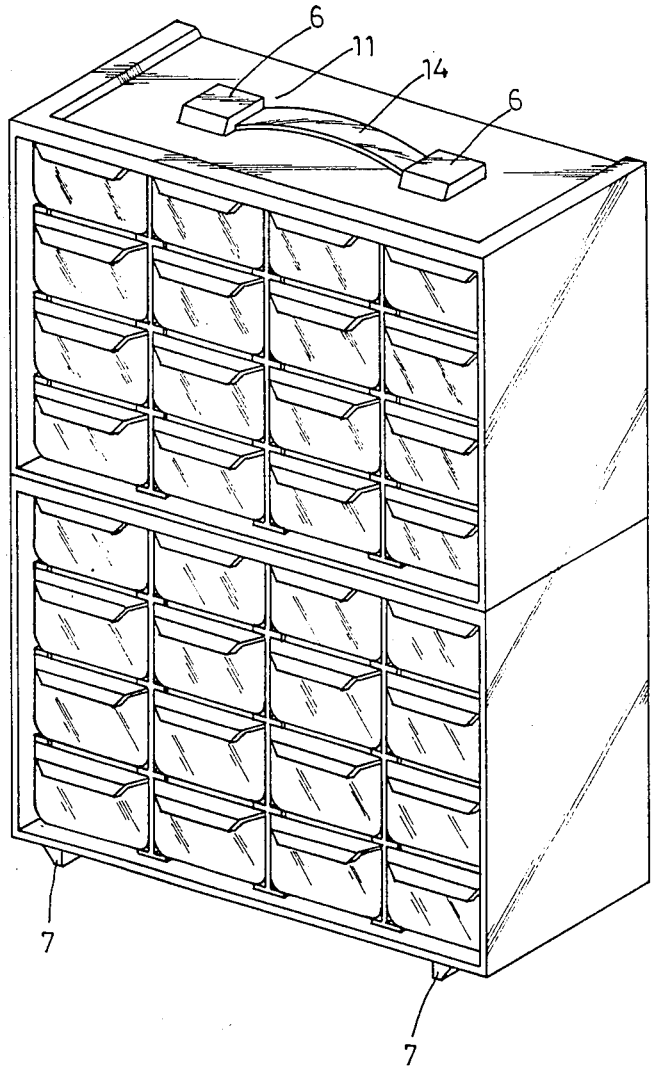
FIG. 7 is a perspective view showing the combination of two stacked cabinets.
Figure 8:
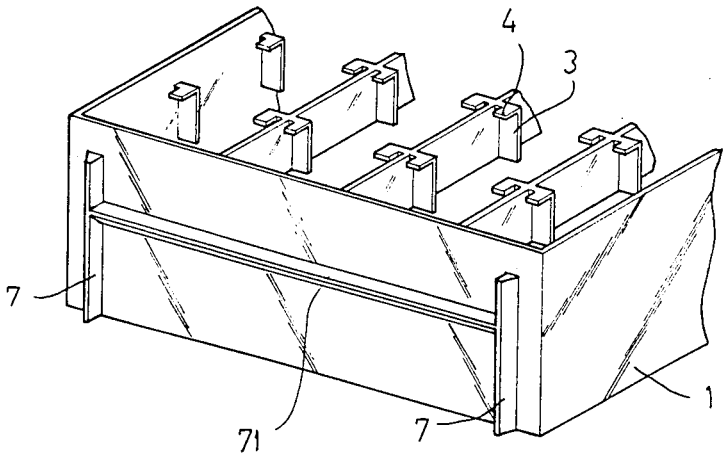
FIG. 8 shows the bottom of the cabinet.

With reference to FIGS. 1, 7 and 8, the framework 1 is provided on the top with raised edges 112 having an inclined surface 113. The bottom of the framework 1 is provided with two parallel legs 7 and a transverse rod 71 connecting the two legs 7. Legs 7 and rod 71 also have inclined surfaces. The inclined surface 113 of the raised edges 112 and that of retaining means 6 are configured for corresponding engagement with the inclined surfaces of legs 7 and transverse rod 71 so that the present cabinet can be stacked in a stable manner.

Figure 5:
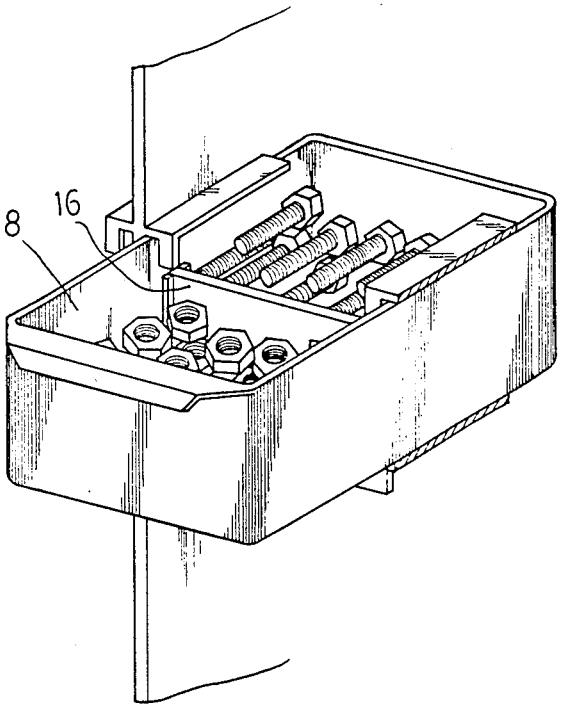
FIG. 5 shows an application of the cabinet.
Figure 6:
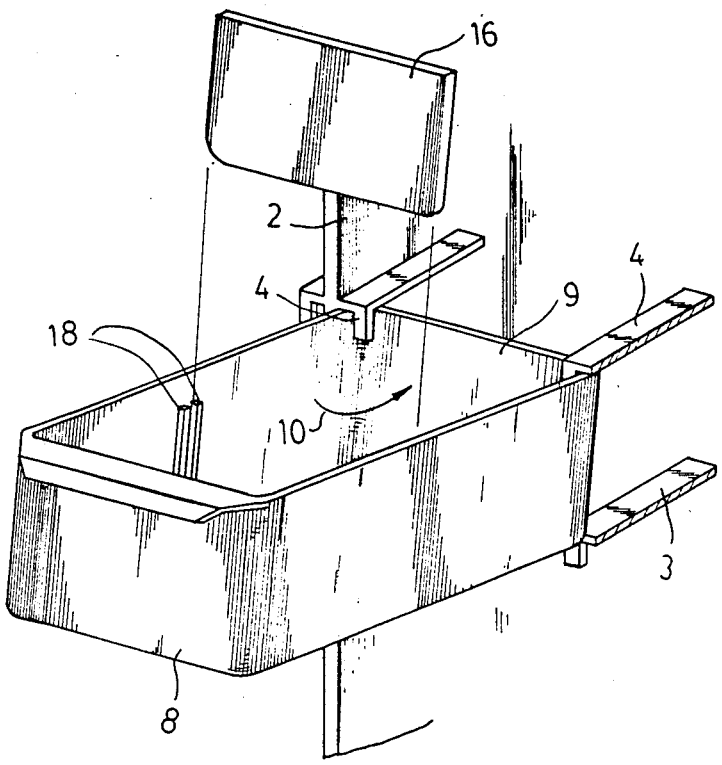
FIG. 6 shows the manner in which the drawer is assembled to the body portion of the cabinet.
Figure 6:
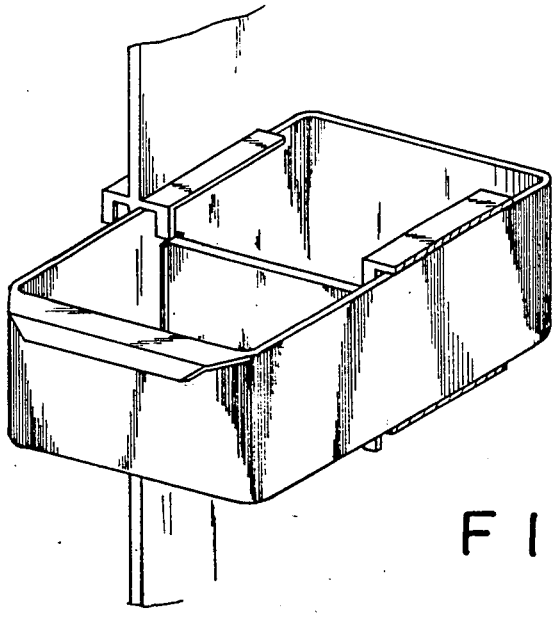

FIG. 6 illustrates how the drawer 8 can be incorporated into the framework 1. The drawer 8 according to the present invention is substantially a rectangular receptacle having a partition panel 16 which may be detachably fixed between two pairs of guide rods 18 set on the middle area of two opposite side walls in drawer 8 so as to divide the inner space of the drawer 8 into two compartments. FIG. 5 shows that a number of bolts and screws are stored in the drawer 8.

Although this invention has been described with a certain degree of particularity, it is understood that the present disclosure has been made by way of example only and that numerous changes in the detail of construction and the arrangement of parts may be resorted to without departing from the spirit and scope of the invention as hereinafter claimed.

I claim:

1. A cabinet for storing small parts such as bolts, screws or the like, comprising:

(a) a framework including a top wall, a bottom wall and two sidewalls, each sidewall being provided with a plurality of horizontal flanges on an inner surface thereof, with the top of the framework being provided with raised edges having inclined surfaces;

(b) a plurality of vertical panels disposed between the top and bottom walls of the framework, each side of each vertical panel being provided with a plurality of horizontal supporting strips, with each strip including a stop extending from a front end thereof;

(c) a plurality of drawers slidably receivable within the framework along the horizontal flanges and supporting strips;

(d) supporting means provided on the bottom wall of the framework and including two parallel legs and a transverse rod connecting the legs, the legs and transverse rod being each provided with an inclined surface;

(e) retaining means provided on the top wall of the framework and including two spaced blocks integrally formed with the top wall, each block being hollow and provided with an inclined surface and a notch in the rear of each block;

(f) a stretchable handle including two enlarged ends, each enlarged end being disposable through the notch of a coresponding block, the handle being longer than the distance between the two blocks so as to permit the handle to be disposed in a first position wherein a gripping space is provided between the handle and the top wall, and a second position wherein the handle is disposed substantially flat with the enlarged ends being inserted within the blocks; and (g) the inclined surfaces of the raised edges being configured for corresponding engagement by the inclined surfaces of the legs, and the inclined surface of the transverse rod being configured for corresponding engagement with the inclined surfaces of the blocks so as to permit the stable stacking of one cabinet on another.

* * * * *